United States Patent [19]

Evens

[11] 4,416,323

[45] Nov. 22, 1983

[54] AIR COOLER FREEZE PROTECTION

[75] Inventor: David A. Evens, Cloquet, Minn.

[73] Assignee: Conoco Inc., Ponca City, Okla.

[21] Appl. No.: 191,881

[22] Filed: Sep. 29, 1980

[51] Int. Cl.[3] ..... F28F 11/00

[52] U.S. Cl. ..... 165/11 R; 116/101; 165/39; 374/120

[58] Field of Search ..... 165/11 R; 62/125, 128; 73/15 R, 190 R; 116/101, 114.5; 137/551, 552; 340/594, 595, 596, 598; 237/80, 2 B; 126/420

[56] References Cited

U.S. PATENT DOCUMENTS

| | | | |
|---|---|---|---|
| 3,312,274 | 4/1967 | Sebald | 165/11 R |
| 3,556,204 | 1/1971 | Dehne | 165/111 |
| 4,153,040 | 5/1979 | Harrison et al. | 126/420 |

*Primary Examiner*—William R. Cline
*Assistant Examiner*—John F. McNally
*Attorney, Agent, or Firm*—Richard W. Collins

[57] ABSTRACT

Cold weather operation of a heat exchanger which utilizes ambient air to cool a process stream containing water is monitored by a series of thermocouples placed in the heat exchanger tubes subjected to the coldest air. A scanner monitors the thermocouples and alerts operators to unsafe or potentially freezing temperature conditions in the tubes.

4 Claims, 5 Drawing Figures

AIR COOLER FREEZE PROTECTION

BACKGROUND OF THE INVENTION

1. Field of the Invention

This invention relates to operation of ambient air-cooled heat exchangers, and more particularly to monitoring the operation of such heat exchangers during very cold weather.

Heat exchangers using ambient air as the cooling medium are used in many industrial processes. For example, the overhead stream from petroleum refinery fluid catalytic cracker main fractionators is often condensed and cooled by air-cooled heat exchangers. The overhead stream from these fractionators typically contains a substantial amount of water, such as from 5 to 10 weight percent. These heat exchangers may be single pass units having a large number of parallel tubes. In a typical unit, upflow induced-draft fans pull cooling air over the tube bundles, and some means of controlling the airflow, such as adjustable louvers, is generally used in conjunction with fan control to regulate the cooling.

In very cold climates, where ambient air temperatures reach −20° C. and lower, there is a potential problem of freeze-up in the tubes due to the very cold air causing freezing of water in the tubes. This can lead to rupturing of a tube with serious consequences. Hydrocarbons leaking from a ruptured tube can present a serious fire hazard.

2. The Prior Art

Several methods have been considered or actually tried in an effort to eliminate the problem of tube freeze-up.

One proposed solution involved attaching thermocouples to the outside of the tubes which are subjected to the coldest air. The thermocouples are located near the outlet ends of the tubes as this was the coldest part of each tube. These thermocouples were connected to a monitor to provide operators with an indication of potentially freezing conditions. However, even when the thermocouples were heavily insulated, the readings obtained were unreliable and the technique was considered unsatisfactory.

Another proposed solution involved controlling the inlet air louvers in response to the bulk outlet temperature. This was not satisfactory as the relation between bulk outlet temperature and individual tube temperature was indefinite.

Another proposed solution involved partial air recirculation to hold air temperature above the freezing point. However, this would require extensive ductwork and control to provide the proper amount of warm outlet air for mixing with cold inlet air.

Still another proposal involved use of steam coils in the air inlet. This was rejected as expensive and energy inefficient.

Finally, it was proposed to install additional piping which permits shutting off a portion of the tubes during very cold weather. However, this would have required considerable work each time the temperature changed, and for that reason was rejected.

Thus, there has been a long-standing need for an improved method of controlling the operation of an air-cooled heat exchanger in very cold conditions.

SUMMARY OF THE INVENTION

According to the present invention, thermocouples are placed in the outlet ends of those tubes of an air-cooled heat exchanger which are subjected to the coldest air, and the thermocouple readings are monitored to enable an operator to take appropriate action in the event of a potential freeze-up. The thermocouples are contained in elongated thermocouple wells having a small cross section area so that flow through the tubes is hindered a minimum amount.

It is an object of this invention to provide an improved method of controlling the operation of an air-cooled heat exchanger during cold weather.

It is a further object to provide such a method that is relatively inexpensive, convenient and reliable.

The accomplishment of the foregoing objects as well as additional objects and advantages is obtained by the present invention as will be apparent from the following detailed description of the preferred embodiment thereof.

DESCRIPTION OF THE PREFERRED EMBODIMENT

Figure 1:
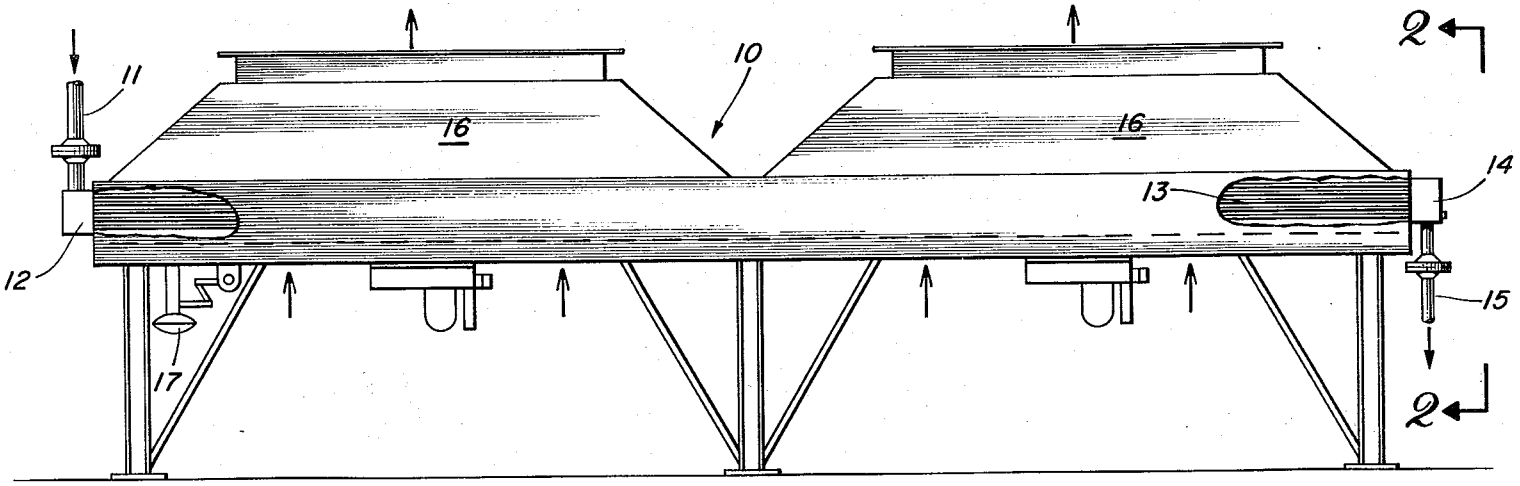
FIG. 1 is a side elevational view, partially cut away, of an air cooler of the type to which the present invention is directed.
Figure 2:
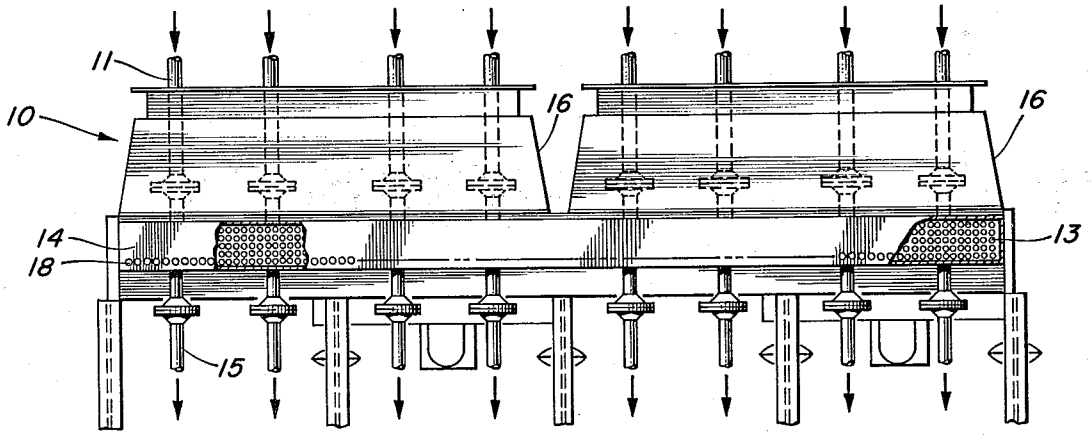
FIG. 2 is an end view, partially cut away, of the air cooler shown in FIG. 1.

Referring to FIGS. 1 and 2, an air-cooled heat exchanger is shown generally at 10. The exchanger 10 includes inlet piping 11 which conducts a hot process stream to be cooled and condensed to an inlet header box 12. From header box 12, the hot fluid enters tubes 13 and passes to outlet header box 14. The condensed and cooled fluid from outlet header box 14 is then removed through outlet piping 15.

Cooling air is drawn over tubes 13 by induced draft fans 16 mounted above the tube bundle. Louver control 17 can be used to regulate the airflow over the tube bundle by opening or closing louvers (not shown) located below the tube handle.

It will be apparent that the lowermost row of tubes will be contacted by the coldest air, so the freeze-up problem is essentially limited to these lowermost tubes. Also, any water which condenses in the inlet header box 12 will tend to gravitate into the lowermost tubes.

Figure 4:
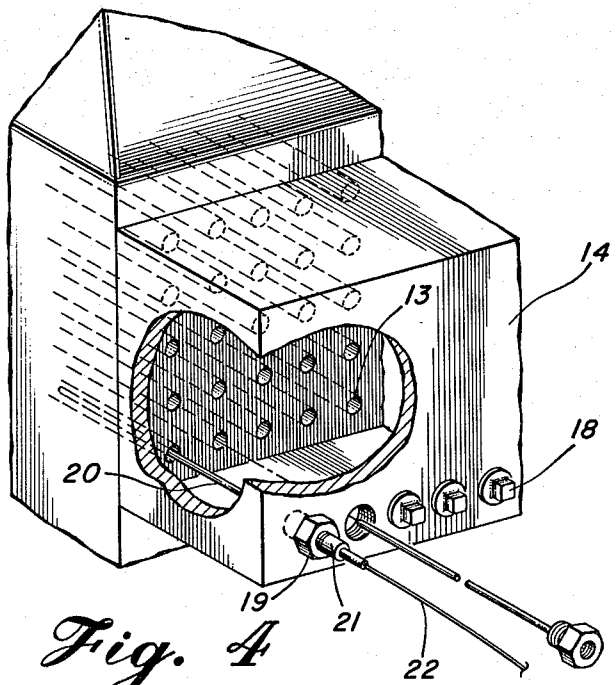
FIG. 4 is an isometric view, partially cut away, showing the arrangement of the thermocouples and tubes in accordance with the invention.

Referring to FIG. 4, cleanout plugs 18 in the outer all of outlet header box 14 are provided in line with the tubes. Only the lower plugs are shown in FIG. 4, but in practice each of the tubes preferably has an associated cleanout plug. This facilitates cleaning the interior of the tubes. If the outlet header does not have cleanout plugs, then openings must be formed in the header box wall in order to practice this invention.

Figure 3:
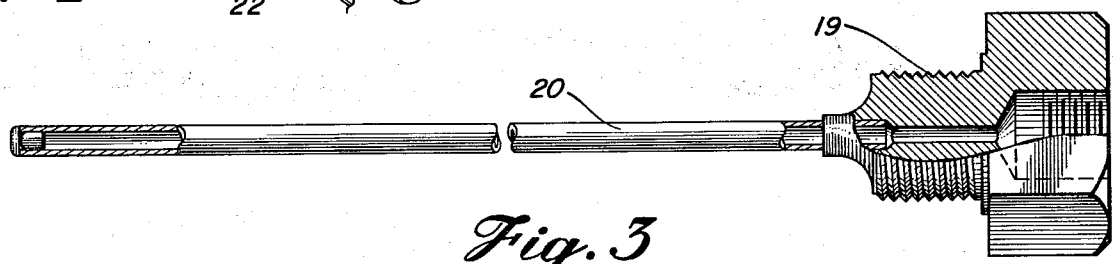
FIG. 3 is a side view, partially cut away, showing a thermocouple well for use in the invention.

Referring to FIG. 3, a thermocouple well 19 of the type preferred for use in this invention is shown. Thermocouple well 19 includes an elongated small diameter section 20. This section 20 should have a cross-sectional area of not more than twenty percent, and preferably not more than ten percent, of the cross-sectional area of the tube in which it is to be placed. This is so the fluid flow interference through the tubes will be minimized. The small diameter section 20 should extend into the outlet end of tube 13 sufficiently far that the effect of the bulk temperature in outlet header box 14 will not significantly influence the reading from the thermocouple.

As best seen in FIG. 4, thermocouple well 19 threads into a cleanout hole in alignment with a tube 13. A packing nut 21 over thermocouple lead 22 secures the thermocouple in the thermocouple well.

Figure 5:
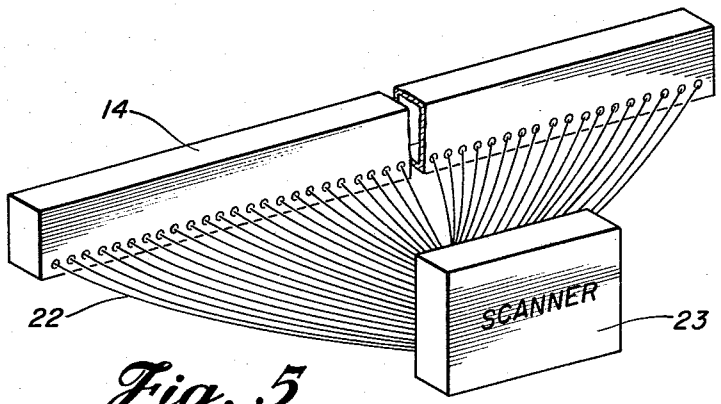
FIG. 5 is a schematic view showing thermocouple leads connected to a scanner for monitoring conditions in the tubes.

As shown schematically in FIG. 5, a series of thermocouple leads 22 extends from each of the bottom row of tubes of an air-cooled heat exchanger to a scanner 23. The scanner preferably is an automatic electronic scanner with an adjustable alarm. The scanner may have a readout or printout, or both, preferably with an audible or visible alarm indicator. Such devices are readily available.

The alarm can be set at a reasonable level above the freezing point of water, such as about 10° C. This provides ample time for control action to be taken in the event that one or more tubes reach this temperature. Appropriate control action might include stopping or slowing one or more fans, or closing the inlet air louvers. It will be appreciated that controlling the operation by measurement of the bulk outlet temperature from outlet header box 14 would be less precise, since colder liquid from the bottom row of tubes would be blended with warmer liquid from the other rows of tubes, making it difficult to determine the actual danger point.

The operation of a heat exchanger in accordance with the invention will now be generally described. First, thermocouples are installed in the row of tubes first contacted by incoming cold air. The thermocouples are installed in thermocouple wells in the outlet end of the tubes and extend into the tubes a sufficient distance to be substantially unaffected by the warmer temperature in the outlet header box. The thermocouple wells block off less than twenty percent of the flow area of the tubes. Thermocouple leads from each thermocouple are connected to a scanning alarm device set to give an alarm upon a preset low temperature being reached. An operator would then take appropriate control action in the event of the alarm being given, preventing the temperature from going lower. Without this control action, freezing up and possibly bursting of one or more tubes would be likely.

The foregoing description is directed to a method of controlling an air cooler having top mounted induced flow fans and a series of rows of tubes carrying a mixture of water and hydrocarbons. It will be appreciated that the invention is equally appropriate for numerous modifications and variations in the equipment utilized and the process stream compositions being treated. Such modifications and variations, even if not specifically described, are intended to be included within the scope of the invention, which is defined in the appended claims.

I claim:

1. A method of protecting an ambient air cooled heat exchanger having a plurality of rows of tubes from freeze-up during cold weather operation comprising:

(a) inserting, from the outlet ends thereof, thermocouple means into the interior of tubes in the row nearest the incoming cooling air, said thermocouple means being positioned far enough in said tubes to substantially negate the effect of the temperature of fluid collected from other tubes;

(b) maintaining at least 80 percent of the internal cross-sectional area of said tubes open to flow about said thermocouple means;

(c) monitoring the outputs from said thermocouple means to obtain an indication in the event of the temperature in any of said tubes nearing the freezing point; and (d) reducing the air flow over said tubes in the event of an indication of the temperature in any of said tubes nearing the freezing point.

2. The method of claim 1 wherein said temperature is monitored with an alarm scanning device and wherein air flow over said tubes is reduced in the event of said scanning device signaling a low temperature alarm.

3. The method of claim 1 wherein at least 90 percent of the cross-sectional area of said tubes is maintained open to flow about said thermocouple means.

4. The method of claim 1 wherein the fluid being cooled in said heat exchanger is a liquid hydrocarbon stream containing a substantial amount of water.

* * * * *